US010161730B2

(12) United States Patent
Hupp

(10) Patent No.: US 10,161,730 B2
(45) **Date of Patent: *Dec. 25, 2018**

(54) EXPLOSIVE DEVICE SIMULATOR

(71) Applicant: Remington Lee, LLC, San Diego, CA (US)

(72) Inventor: Mark Hupp, Lemon Grove, CA (US)

(73) Assignee: Remington Lee, LLC, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/601,336

(22) Filed: May 22, 2017

(65) Prior Publication Data

US 2017/0261293 A1 Sep. 14, 2017

Related U.S. Application Data

(63) Continuation of application No. 14/716,800, filed on May 19, 2015, now Pat. No. 9,658,039.

(51) Int. Cl.

| | |
|---|---|
| ***C06B 45/00*** | (2006.01) |
| ***F42B 8/28*** | (2006.01) |
| ***C06B 43/00*** | (2006.01) |
| ***F42B 8/02*** | (2006.01) |
| *D03D 23/00* | (2006.01) |
| *D03D 43/00* | (2006.01) |
| *F42B 12/20* | (2006.01) |
| *F42B 12/24* | (2006.01) |

(52) U.S. Cl.

CPC ..... *F42B 8/28* (2013.01); *C06B 43/00* (2013.01); *F42B 8/02* (2013.01); *F42B 12/207* (2013.01); *F42B 12/24* (2013.01)

(58) Field of Classification Search

USPC ..... 149/1, 2, 108.2, 109.2, 109.4

See application file for complete search history.

(56) References Cited

U.S. PATENT DOCUMENTS

| | | | | |
|---|---|---|---|---|
| 4,392,432 A * | 7/1983 | Fenrick | F42B 5/145 102/275.11 |
| 5,359,936 A * | 11/1994 | Simpson | A01K 15/02 102/355 |
| 5,648,636 A * | 7/1997 | Simpson | A01K 15/02 102/355 |
| 9,658,039 B2 * | 5/2017 | Hupp | F42B 8/28 |
| 2003/0054322 A1 * | 3/2003 | Sansolo | F41A 33/04 434/11 |

(Continued)

*Primary Examiner* — James E McDonough

(74) *Attorney, Agent, or Firm* — Patterson & Sheridan, LLP

(57) ABSTRACT

Embodiments disclosed herein provide an Explosive Device Simulator (EDS). Embodiments of the Explosive Device Simulator may include two or more chemical components that are non-explosive when separated from each other within the EDS, but which form an explosive mixture or substance when combined. Because the individual chemical components are non-explosive, the Explosive Device Simulator may be stored, transported and handled safely for long periods of time and without increased security, protective measures, or special training. Further, the chemical components may be chosen such that the Explosive Device Simulator creates a realistic explosion (e.g. loud and bright), but which produces minimal concussive forces and is therefore safer to use as a training aid.

20 Claims, 4 Drawing Sheets

(56) References Cited

U.S. PATENT DOCUMENTS

| | | | | |
|---|---|---|---|---|
| 2004/0200374 | A1* | 10/2004 | Sansolo | F41A 33/04<br>102/367 |
| 2007/0169658 | A1* | 7/2007 | Brock | F41A 33/04<br>102/367 |
| 2009/0194744 | A1* | 8/2009 | Adebimpe | A01K 15/02<br>252/408.1 |
| 2012/0180679 | A1* | 7/2012 | Schaeffer | F41A 33/04<br>102/206 |

* cited by examiner

EXPLOSIVE DEVICE SIMULATOR

CROSS REFERENCE TO RELATED APPLICATIONS

This Application is a continuation under 35 U.S.C. § 120 of U.S. patent application Ser. No. 14/716,800, filed May 19, 2015, which is now issued as U.S. Pat. No. 9,658,039. The entire contents of the aforementioned application is hereby incorporated by reference.

BACKGROUND OF THE INVENTION

Embodiments described herein relate to the field of explosive devices, and more specifically to an Explosive Device Simulator (EDS).

Improvised Explosive Devices (IEDs) are often homemade bombs with two primary component parts: an explosive substance and a detonation mechanism. The explosive substance may be a variety of substances from conventional explosives substances (e.g. TNT, Semtex, RDX, and other plastic explosives) to unspent munitions (e.g. artillery shells) to unconventional explosives using combustible materials (e.g. gasoline). Similarly, detonation mechanisms can take many forms, such as: a simple fuse, a remote control, an infrared or magnetic trigger, a pressure-sensitive bar or trip wire, a cellular-based remote, and others as are known in the art. IEDs and other incendiary devices, unfortunately, are responsible for an increasing percentage of casualties in conflict zones around the world.

A primary difficulty with respect to IEDs is the ease with which an enemy may covertly deploy them. An IED may be, for example, buried beneath transient objects like trash, built into a structure, or hidden "in plain sight" within common product packaging. Detection of IEDs may be performed remotely by robotic or other electronic means or manually by Explosive Ordinance Detection (EOD) personnel (and other similarly trained professionals), combat personnel, and others. Critical to the success of both remote and manual detection of an IED, and the subsequent disarming and/or disposal of the IED, is proper training. Historically, however, it has been difficult to offer proper training to EOD or similar personnel due to the inherent danger of the subject matter, namely: things that explode. While training on inert devices can be useful for the basic mechanics of IED location, disarming, and disposal, the lack of an explosive element to the inert device does not instill the same sort of stress and fear that personnel may face when dealing with a real explosive device. On the other hand, training with an explosive device may be more realistic, but may also lead to unintended injury of EOD or similar personnel. Ultimately, the best way to train for IED location, disarming, and disposal is to create scenarios that are as life-like as possible. While seemingly unpleasant, training under stressful and fear-inducing circumstances better simulates the real world challenge of detecting, disarming, and disposing of IEDs and other explosive devices.

Further complicating the training of EOD or similar personnel is the fact that there are myriad different types of IEDs, which are able to be concealed and triggered in myriad different ways. Traditional training exercises have used pyrotechnic devices (such as fireworks) or propane gas in a steel container in order to simulate an IED. However, devices such as fireworks can be very dangerous to use as training aids due to their volatility around, for example, heat and static electricity. Further, fireworks tend to comprise toxic ingredients and may create toxic byproducts after detonation. Propane container-based devices tend to be large and cumbersome such that they may not be deployed in ways that real IEDs are in modern combat zones. As such, traditional training aids are not ideal for training EOD and similar personnel for real-life scenarios.

Thus, there is a need for a way to simulate explosions both in physical implementation and in effect. More particularly, what is needed is an Explosive Device Simulator (EDS) that is easy to store, safe to transport, capable of emulating real-world IED design and placement, and capable of a creating a realistic explosion (e.g. in terms of sight and sound), but an explosion with a minimally concussive blast that is safer for training personnel and trainees alike.

SUMMARY

Various embodiments described below relate to an Explosive Device Simulator (EDS). In one embodiment, an explosive device simulator comprises a first chemical component container; a second chemical component container; a mixing chamber; a mixing control mechanism; and a detonator. Some embodiments may further comprise a first chemical component and a second chemical component. Some embodiments may further comprise a detonator controller. Some embodiments may further comprise an explosion control feature.

In another embodiment, an explosive device simulator comprises a first chemical component container containing a first chemical component; a mixing chamber containing a second chemical component; a mixing control mechanism; and a detonator. Some embodiments may further comprise a catalyst configured to catalyze the chemical reaction between the first chemical component and the second chemical component.

In some embodiments, the first chemical component and the second chemical component form an explosive mixture when mixed. In some embodiments, the first chemical component is hydrogen peroxide (H2O2). In some embodiments, the second chemical component is calcium carbide (CaC2). In some embodiments, the mixing chamber comprises a rigid material. In some embodiments, the mixing control mechanism is a valve. In some embodiments, the mixing chamber comprises a non-rigid, flexible material. In some embodiments, the mixing chamber comprises a balloon. In some embodiments, the first chemical component container is within a flexible container, and the flexible container includes at least one perforated seal. In some embodiments, the first chemical component container is a gel capsule.

DETAILED DESCRIPTION OF CERTAIN INVENTIVE EMBODIMENTS

Figure 1:
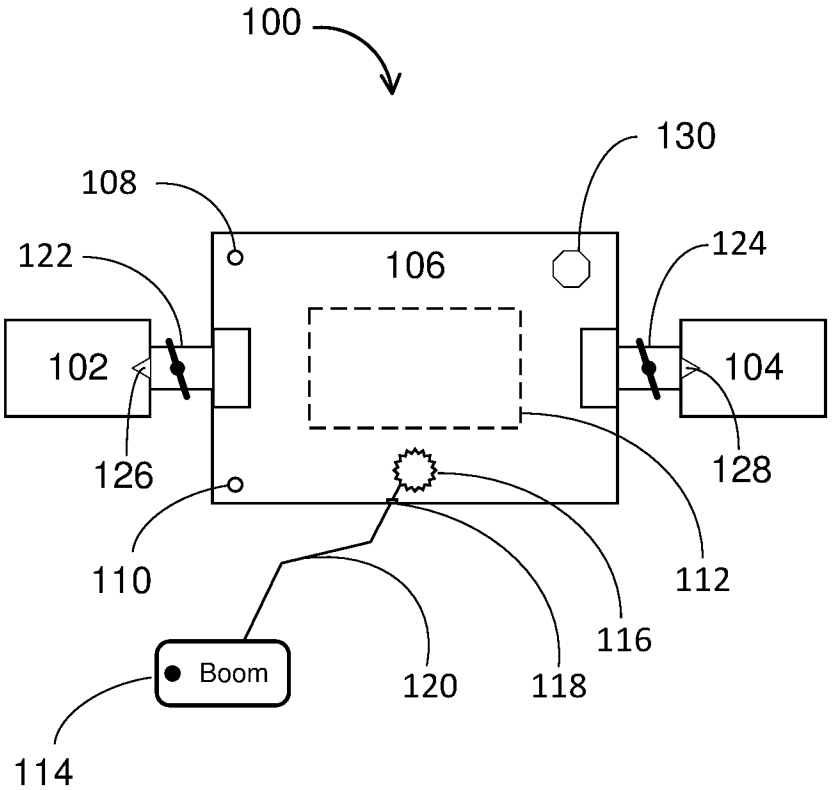
FIG. 1 is a schematic view of an embodiment of an Explosive Device Simulator.

Embodiments disclosed herein provide an Explosive Device Simulator (EDS). Embodiments of the Explosive Device Simulator may include two or more chemical components that are non-explosive when separated from each other within the EDS, but which form an explosive mixture or substance when combined. Because the individual chemical components are non-explosive, the Explosive Device Simulator may be stored, transported and handled safely for long periods of time and without increased security, protective measures, or special training. Further, the chemical components may be chosen such that the Explosive Device Simulator creates a realistic explosion (e.g. loud and bright), but which produces minimal concussive forces and is therefore safer to use as a training aid.

An Explosive Device Simulator may be used, for example, to train EOD and other personnel for the detection, disarming, and disposal of IEDs and other explosive devices. An Explosive Device Simulator may also be used for creating realistic effects in an entertainment environment, e.g. on the set of a movie or television show.

Embodiments of Explosive Device Simulators may comprise several component parts, including, for example: a first chemical component container, a second chemical component container, a first chemical component, a second chemical component, a mixing chamber, a mixing control mechanism, a detonator, a detonator controller, and explosion control features. Note, however, that this list is exemplary, and features may be implemented or not as described in more detail below.

An Explosive Device Simulator may comprise one or more chemical component containers that contain a chemical component that, when mixed with one or more additional chemical components, becomes explosive, but is otherwise non-explosive while contained within the chemical component container. A chemical component container may include a connector in order to connect to or otherwise interface with a mixing chamber. For example, the connector may be a threaded connector meant to thread into a complimentary connector in a mixing chamber. In other embodiments, a chemical component container may be self-contained and meant to be enclosed by other components of an Explosive Device Simulator without a rigid connection.

A chemical component container may be made of any suitable material, including hard or soft plastics, synthetic plastic polymers, metals, rubbers, latex, silicon, composites (e.g. fiberglass epoxy and carbon fiber, paper, cardboard, fabrics, impregnated fabrics and others as are known by those of skill in the art. It is only important that the material makeup of the chemical component container is not reactive with the chemical component stored therein so as to maintain the integrity of the container.

In some embodiments, a chemical component container may be designed to degrade after coming in contact with a substance, such as water and/or other substances as are known in the art. For example, a chemical component container may comprise a gel capsules, similar to a medication gel capsule, which degrades in the presence of moisture. In such cases, the chemical component container may delay the initiation of a reaction between the one or more chemical components and add an additional level of safety to the Explosive Device Simulator.

A chemical component container may contain a premeasured amount of chemical component so as to control characteristics of the explosive mixture once combined with one or more chemical components in, for example, a mixing chamber. In this way, the explosive force of an Explosive Device Simulator may be controlled precisely and may be made predictable and repeatable.

An Explosive Device Simulator may comprise a mixing chamber that is configured to attach to, connect to, envelop or otherwise interface with one or more chemical component containers so as to receive the chemical components from each chemical component container. For example, where there are first and second chemical component containers containing first and second chemical components, the mixing chamber may be configured to receive the first chemical component from the first chemical component container and the second chemical component from the second chemical component container in order to form an explosive mixture or substance within the mixing chamber. In other embodiments, the mixing chamber may be configured to receive additional chemical components from additional component containers. In yet other embodiments, the mixing chamber may also act as a chemical component container.

In some embodiments, the mixing chamber may be a rigid material that holds a set shape. For example, in some embodiments, the mixing chamber may be a solid plastic material in a fixed shape. In other embodiments, the mixing chamber may be a flexible and/or stretchable material. For example, the mixing chamber may be a bag, a bladder, a balloon or the like. The mixing chamber may be made of any suitable material, including hard or soft plastics, synthetic plastic polymers, metals, rubbers, latex, silicon, composites (e.g. fiberglass epoxy and carbon fiber, paper, cardboard, fabrics, impregnated fabrics and others as are known by those of skill in the art.

The mixing chamber may also include an access port for a detonator. Alternatively, the access port may allow access to detonator control elements, such as wires going from an external detonator controller to a detonator within the mixing chamber. In both scenarios, the mixing chamber may include a seal within the access port (e.g. around the detonator or detonator control element) in order to create an air-tight seal in the mixing chamber.

In some embodiments, the mixing chamber is made from a lightweight, fragment resistant material such as a plastic material, which is less likely to cause injury from impact or burning, even when an Explosive Device Simulator is detonated at close range. Notably, while referred to as a mixing "chamber," the size, shape, and material of the chamber need only be sufficient to allow for mixing of the chemical components to form an explosive mixture or substance. Otherwise, the mixing chamber need not conform to any particular shape or style. In some embodiments, the mixing chamber may be a completely deformable shape, such as a sealed bag or bladder. In other embodiments, the mixing chamber may be a robust shape, such as a cylinder, or any other shape formable by robust materials.

In some embodiments, the mixing chamber may include one or more explosion control features that are designed to control the path and strength of the explosion. For example, the mixing chamber may be a solid material, such as a solid plastic, but may include control features such as striations, channels, grooves, cuts, dimples, areas of reduced thickness, pre-stressed areas, or other physical features which may cause the container to fragment more easily, or in a particular pattern, upon exploding. In this way, a wide variety of robust materials may be used for forming the mixing chamber, while still controlling the character of the resulting explosion.

In some embodiments, the mixing chamber may include a vacuum port or valve. The vacuum port or valve may be used in certain embodiments in order to create a vacuum within the mixing chamber such that the vacuum pressure may subsequently be used to draw chemical components into the mixing chamber by negative pressure force. In such embodiments, the vacuum within the mixing chamber may increase the speed and quality of the mixing of the chemical components in order to form the explosive mixture.

In some embodiments, the mixing chamber may include a release port or valve. The release port of valve may be used in certain embodiments to evacuate the mixing chamber in order to render safe an Explosive Device Simulator that has previously been made ready or "armed" by mixing the two or more chemical components. In some embodiments, the vacuum port (or valve) and release port (or valve) may be a single assembly.

In some embodiments, the mixing chamber may include a safe mechanism that compromises the seal or the structure of the mixing chamber. For example, in some embodiments, a flexible mixing chamber may include a string which, when pulled, cuts or otherwise compromises the mixing chamber such that the contents of the mixing chamber are scattered and rendered inert.

In some embodiments, the mixing chamber may include connectors, such as threaded connections, in order to connect with chemical component containers having complimentary connectors. The ports may further include piercing elements that pierce or otherwise break a seal on a chemical component container. In this way, the chemical component container may be threaded into the mixing chamber port thereby creating a seal before the piercing element pierces the seal on the chemical component container and makes the chemical component ready for mixing in the mixing container. In such embodiments, one or more mixing valves may contain the chemical component and prevent it from moving into the mixing chamber despite the seal on the chemical component container being broken.

In some embodiments, the mixing chamber may be connected to valve assemblies that are then connected to chemical component container. In such embodiments, piercing elements may instead be integral with the valve assemblies to which the chemical component container are attached.

In some embodiments, the mixing chamber may include chemical indicators that indicate the presence of one or more chemical components, such as an explosive mixture. In this way, a clear explosive mixture may be indicated as present within the mixing chamber. Such an indicator may improve the safety of the device by indicating when the Explosive Device Simulator is "armed" or even indicating if the Explosive Device Simulator has a dysfunctional (e.g. leaky) component. Even though properly designed Explosive Device Simulators are not meant to be deadly even when exploding, additional safety features are still advantageous for handling, storage, and transportation.

An Explosive Device Simulator may comprise one or more mixing control mechanism such as a valve. The mixing control mechanism may control the mixing of two or more chemical components in order to create an explosive mixture or substance. In some embodiments, the Explosive Device Simulator may only have a single mixing control mechanism, such as one valve separating a mixing chamber comprising one chemical component from a chemical component container. In other embodiments, the Explosive Device Simulator may have multiple mixing control mechanisms, such as multiple valves. In some embodiments, the mixing control mechanisms may be manually operated, such as a lever or handle-operated valve. In other embodiments, the mixing control mechanism may be electronically controlled, such as by an electronic controller. In yet further embodiments, the Explosive Device Simulator may not comprise a mixing control mechanism other than a seal, barrier, or the like that is broken in order to allow the chemical components to mix.

As described above, in some embodiments the chemical component container acts as a mixing control mechanism by, for example, degrading in the presence of specific substances. For example, a gel capsule containing one chemical component may be exposed to a second chemical component which causes the gel capsule to degrade and eventually release the first chemical component into the second chemical component. In such cases, the mixing is controlled based on a time delay for the chemical component container to sufficiently degrade and fail.

An Explosive Device Simulator may comprise two or more chemical components used to form an explosive mixture or substance. When two chemical components are used to form an explosive mixture, the resulting explosive mixture or substance may be referred to as a two-component explosive or a binary explosive. Ideally, such explosive mixtures are formed from components that are not explosive independently, but only become explosive after being mixed. Many examples of binary explosive substances are known, such as liquid oxygen and combustible powders, ammonium nitrate and fuel oil, ammonium nitrate and nitromethane, ammonium nitrate and aluminum, and others as are known in the art.

In some embodiments of an Explosive Device Simulator, more than two chemical components may be combined to form an explosive mixture or substance. For example, three or more chemical components may be used. In some embodiments, each chemical component is stored within a dedicated component container, while in others, more than one chemical component may be stored in a single component container so long as those chemical components are not-explosive when stored together.

In some embodiments, a moderating chemical component may be used in order to further control the characteristic of the explosion, or to render the explosive mixture inert (e.g. to disarm the Explosive Device Simulator). For example, a catalyst (chemical component) may be used to control the mixing reaction of other chemical components thereby improving the performance of the mixture. In some embodiments, the catalyst can be an enzyme, such as enzymes found in yeast, or an oxidized metal, such as aluminum, copper, iron oxide.

In some embodiments, an Explosive Device Simulator includes calcium carbide ($CaC_2$) as a first chemical component and hydrogen peroxide ($H_2O_2$) as a second chemical component. When these chemical components (i.e. calcium carbide and hydrogen peroxide) are mixed, for example, within a mixing chamber of an Explosive Device Simulator, a chemical reaction creates an explosive mixture comprising acetylene gas ($C_2H_2$) and oxygen gas ($O_2$). The chemical reaction used to create the acetylene gas mixtures is exemplified by the following:

$$2CaC_2+2H_2O_2+2H_2O \rightarrow 2Ca(OH)_2+2C_2H_2+O_2$$

In the reaction equation above, $CaC_2$ is solid calcium carbide, $H_2O_2$ is liquid hydrogen peroxide, $Ca(OH)_2$ is solid calcium hydroxide, $C_2H_2$ is gaseous acetylene, $H_2O$ is liquid water, and $O_2$ is gaseous oxygen. When the explosive mixture of acetylene gas ($C_2H_2$) and oxygen gas ($O_2$) is detonated by a detonator of the Explosive Device Simulator, it creates an explosion. Notably, acetylene gas can be made by many different chemical reactions, as are known in the art.

An advantage of the binary explosive mixture above is that the component parts are non-toxic and biodegradable before and after being mixed, which is unlike many traditional explosive substances. Traditional explosive materials tend to be toxic and/or corrosive, and require special handling and disposal measures.

As mentioned above, in some embodiments a catalyst may be used to improve the reactivity of the hydrogen peroxide ($H_2O_2$) so that a lower concentration of hydrogen peroxide ($H_2O_2$) relative to water may be used, which makes the mixture safer to use. The catalyst can be in a gel capsule or it can be in the mixing chamber, or it can mixed in with the calcium carbide.

An Explosive Device Simulator may comprise a detonator such as an ignitor, blasting cap, squib, electronic match, miniature explosive device, or other types of detonators as are known in the art. The detonator may be placed within the mixing chamber or in an adjacent location such that the action of the detonator will cause an explosion of the explosive substance or mixture within the mixing chamber. In some embodiments, the Explosive Device Simulator comprises multiple detonators. In such embodiments, the multiple detonators may help to create a better explosion where the explosive mixture is dispersed within a relatively large mixing chamber.

An Explosive Device Simulator may comprise a detonator controller. The detonator controller may be as simple as a fuse or more complicated, such as a timed device, a radio frequency controlled device, a micro-controller device, a computer device, a sensor-based device (e.g. magnetic, infrared, pressure, tilt, etc.), and others as are known in the art. The detonator controller need only be capable of causing the detonator to detonate the explosion with the mixing chamber. In some embodiments, the detonator controller is connected to the detonator by detonator control elements, such as wires. In some embodiments, the detonator controller and the detonator may be integral and within the mixing chamber. In some embodiments, the detonator controller may be battery operated.

In some embodiments, an electronic controller may control both the detonator and the mixing control mechanism(s). Additionally, an electronic controller may receive signals from sensors associated with an Explosive Device Simulator, such as an electronic chemical indicator.

In some embodiments, aspects of the Explosive Device Simulator may be made through additive manufacturing techniques, such as 3D printing. Such manufacturing techniques allow for a wide variety of shapes and forms to be used when constructing components of an Explosive Device Simulator. Further, such manufacturing techniques may allow for precise features, such as explosion control features, to be integrated into the Explosive Device Simulator in order to make the Explosive Device Simulator safer and more reusable.

FIG. 1 is a schematic view of an embodiment of an Explosive Device Simulator 100. Explosive Device Simulator 100 includes first chemical component container 102 comprising a first chemical component and second chemical component container 104 comprising a second chemical component. Chemical component containers 102 and 104 may be reusable containers including a pre-measured amount of first and second chemical components. Chemical component containers 102 and 104 may also include integral connectors, such as threaded connectors for interfacing and connecting with mixing chamber 106. Further, chemical component containers 102 and 104 may include a seal or barrier (not shown) that retains the chemical component when not in use. The seal or barrier may be pierced or broken, for example, by a piercing element, such as piercing elements 126 and 128. In this way, chemical component containers remain sealed until attached to mixing chamber 106.

Explosive Device Simulator 100 also includes mixing chamber 106, wherein the first and second chemical components may be mixed to form an explosive mixture or substance. The introduction into the mixing chamber 106 of the first and second chemical components may be controlled by mixing control mechanisms, such as valves 122 and 124. In this embodiment, valves 122 and 124 represent manually operated valves. But in other embodiments, the valves may be different types of valves as are known in the art, including electronically controlled valves.

Mixing chamber 106 of Explosive Device Simulator 100 includes a vacuum port 108, which may be used to form a vacuum within mixing chamber 106 prior to mixing any chemical components.

Mixing chamber 106 of Explosive Device Simulator 100 also includes a release port 110, which may be used to evacuate the mixing chamber after one or more chemical components has been introduced, e.g., from chemical component container 102 or 104 (or both). Additionally, release port 110 may control the volume and/or pressure of explosive mixture within mixing chamber 106. For example, release valve 110 may automatically release an amount of an explosive mixture of the pressure within mixing chamber 106 becomes higher than a desired or designed threshold.

Mixing chamber 106 of Explosive Device Simulator 100 also includes an explosion control feature 112. In this embodiment, explosion control feature 112 includes areas of intentional weakening (such as by striations) in the body of the mixing chamber 106. Such explosion control features may be configured to control the force and direction of any explosion. Further, explosion control features 112 may be used to control the fragmentation of the Explosive Device Simulator 100.

Within mixing chamber 106 is a detonator 116. For example, detonator 116 may be a squib, fuse, electronic match, or similar device capable of causing a detonation of an explosive mixture or substance within mixing chamber 106.

Mixing chamber 106 also includes a seal 118 through which detonator control element 120 pass in order to get to detonator 116. In some embodiments, the detonator control element may be an electronic wire or a fuse. Seal 118 forms an air-tight seal around the detonator control element 120 so that no explosive mixture is released from mixing chamber 106.

Detonator controller 114 is connected to detonator control elements 120 and thereby to the detonator 116. Detonator controller 114 may be a manual detonator controller, such a switch, a striker, or a mechanical match, or an electronic controller, such as a microprocessor, microcontroller, a circuit, a radio controlled device, a sensor, a cellular phone, a timed device, a computing device, or others as are known in the art. In some embodiments, detonator controller 114 may comprise a sensor, such as a force sensor, proximity sensor, capacitance sensor, magnetic sensor, optical sensor, or other sensors as are known in the art.

In some embodiments, detonator controller 114 may be connected to detonator 116 by wireless means, such as by radio frequency signals. In such embodiments, detonator control element 120 and seal 118 may be unnecessary. For example, detonator 116 may include an integral signal receiver powered by an integral power source, such as a battery. In such embodiments, a physical connection between detonation controller 114 and detonator 116 would not be necessary.

Explosive Device Simulator 100 may be activated or armed by opening each of valves 122 and 124 so that the first and second chemical components mix and form an explosive mixture or substance. For example, in one embodiment of an Explosive Device Simulator according to FIG. 1, chemical component container 102 may contain a first chemical component, such as calcium carbide ($CaC_2$), and chemical component container 104 may contain a second chemical component, such as hydrogen peroxide ($H_2O_2$). In embodiments where the second chemical component comprises hydrogen peroxide ($H_2O_2$), water ($H_2O$) may also be included in the chemical component container as a stabilizer and/or moderator. Notably, these chemical components are exemplary, and other chemical components may be used.

The mixing of the first and second chemical components within mixing chamber 106 of Explosive Device Simulator 100 may happen my manual means, such as by gravity mixing or manual agitation (e.g. shaking of the Explosive Device Simulator), or it may happen by pressure-biased means, such as where mixing chamber 106 is in a vacuum state. As described above, mixing chamber 106 may be brought to a vacuum state by, for example, attaching a vacuum pump to vacuum port 108 and drawing an appropriate level of vacuum. Thereafter, when valves 122 and 124 are opened, the vacuum may cause the chemical components to be drawn into the mixing chamber via negative pressure. As such, the mixing of the chemical components may occur more effectively.

Alternatively or additionally, chemical component containers 102 and 104 may be at a positive pressure state so that when exposed to mixing chamber 106 by way of open valves 122 and 124, the chemical components stored within are forced out and into the mixing chamber by positive pressure. In some embodiments, a combination of negative pressure in mixing chamber 106 and positive pressure in chemical component containers 102 and 104 may assist in causing the chemical components to mix more effectively.

In some embodiment, mixing chamber 106 may include a chemical indicator, such as chemical indicator 130. In some embodiments, chemical indicator 130 may be a passive indicator, such as a test strip treated such that when exposed to one or more of the chemical components, or the resulting explosive mixture or substance, the strip indicates (e.g. by change of color) that a particular chemical is present within mixing chamber 106. In other embodiments, chemical indicator 130 may be an active indicator, such as an electronic sensor. In some embodiments, an active chemical indicator may be connected to or otherwise in data communication with a detonation controller, such as detonation controller 114. In this way, the detonation controller may be prevented from detonating before an explosive mixture is present. In other words, the lack of presence of an explosive mixture or substance, as indicated by chemical indicator 130, may prevent "dry firing" of the detonator 116.

Explosive Device Simulator 100 may be detonated after it is armed. In order to detonate Explosive Device Simulator 100, detonator 116 must be detonated. In some embodiments, such as that shown in FIG. 1, an electrical signal may be sent from detonation controller 114 to detonator 116 by way of detonator control element 120 (e.g. by one or more wires). In other embodiments, detonator controller 114 may send a wireless signal to detonator 116 in order to detonate the explosive mixture or substance within mixing chamber 106. In yet other embodiments, detonator 116 may be detonated by means of a fuse such that detonation controller 114 is unnecessary.

Explosive Device Simulator 100 may be disarmed after being armed by, for example, opening release valve 110 and releasing the explosive mixture into the atmosphere. By releasing the explosive mixture out of mixing chamber 106, the Explosive Device Simulator may be rendered non-explosive and thereby safe.

Other embodiments may include an additional chemical component container that contains a chemical component that renders the explosive mixture or substance inert (not shown). In such embodiments, a mixing control mechanism, such as a valve, may be opened to introduce the deactivating chemical component to the explosive mixture in order to render it non-explosive or inert.

Figure 2:
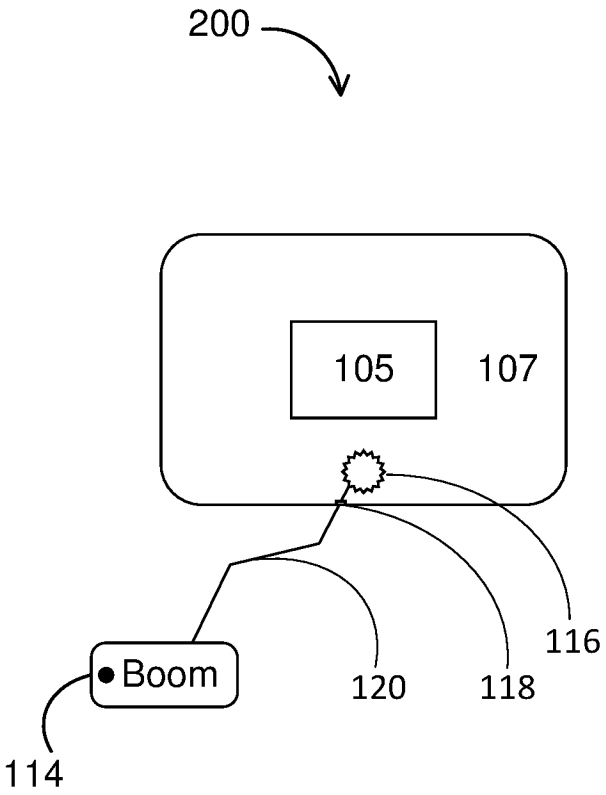
FIG. 2 is a schematic view of another embodiment of an Explosive Device Simulator.

FIG. 2 is a schematic view of another embodiment of an Explosive Device Simulator 200. Notably, here like parts as in FIG. 1 are given like numerals.

In the embodiment depicted in FIG. 2, mixing chamber 107 is also a chemical component container. In one embodiment of an Explosive Device Simulator according to FIG. 2, mixing chamber 107 comprises a vacuum-sealed bag comprising a first chemical component, such as calcium carbide ($CaC_2$). Within mixing chamber 107 is chemical component container 105, which may comprise, for example, a balloon filled with a second chemical component, such as hydrogen peroxide ($H_2O_2$). In embodiments where the second chemical component comprises hydrogen peroxide ($H_2O_2$), water ($H_2O$) may also be included in the chemical component container.

Explosive Device Simulator 200 may further comprise a detonator 116, such as a squib, within the mixing chamber 107. Detonator 116 may be connected to detonator control element 120 (e.g. electric leads), which extend from detonator 116 through a seal 118 in mixing chamber 107.

Explosive Device Simulator 200 is safe for handling, storage and travel while the chemical components in mixing chamber 107 and chemical component container 105 are not mixed.

To activate or "arm" Explosive Device Simulator 200, chemical component container 105 (here, a balloon) is purposefully burst (e.g. by manual force) within the mixing chamber 107 (here, a vacuum-sealed bag). Thereafter, the first chemical component (here, hydrogen peroxide ($H_2O_2$)) and the second chemical component (here, calcium carbide ($CaC_2$)) react to form an explosive mixture (here, acetylene gas ($C_2H_2$) and oxygen gas ($O_2$)). These products expand and fill up the mixing chamber 107 (here, a vacuum-sealed bag 107). Thus, Explosive Device Simulator 200 is armed and ready for detonation.

Notably, in the embodiment depicted in FIG. 2, mixing chamber 107 is not rigid. As such, when the explosive mixture is formed within mixing chamber 107 (here, a vacuum-sealed bag), the mixing chamber "fills up" (i.e. deforms) so that an observer would know that the Explosive Device Simulator was "armed." Thus, in some embodiments, the mixing chamber may act as an indicator that the Explosive Device Simulator is armed without the need for a chemical component indicator.

In order to detonate Explosive Device Simulator 200, detonator 116 is detonated resulting in an explosion that produces a loud "bang" and flash. However, the explosion ideally produces minimal overpressure due to the explosive mixture and design of the mixing chamber. As such, the resulting explosion is viscerally realistic while creating a low risk of injury to personnel or damage to nearby objects.

Figure 3:
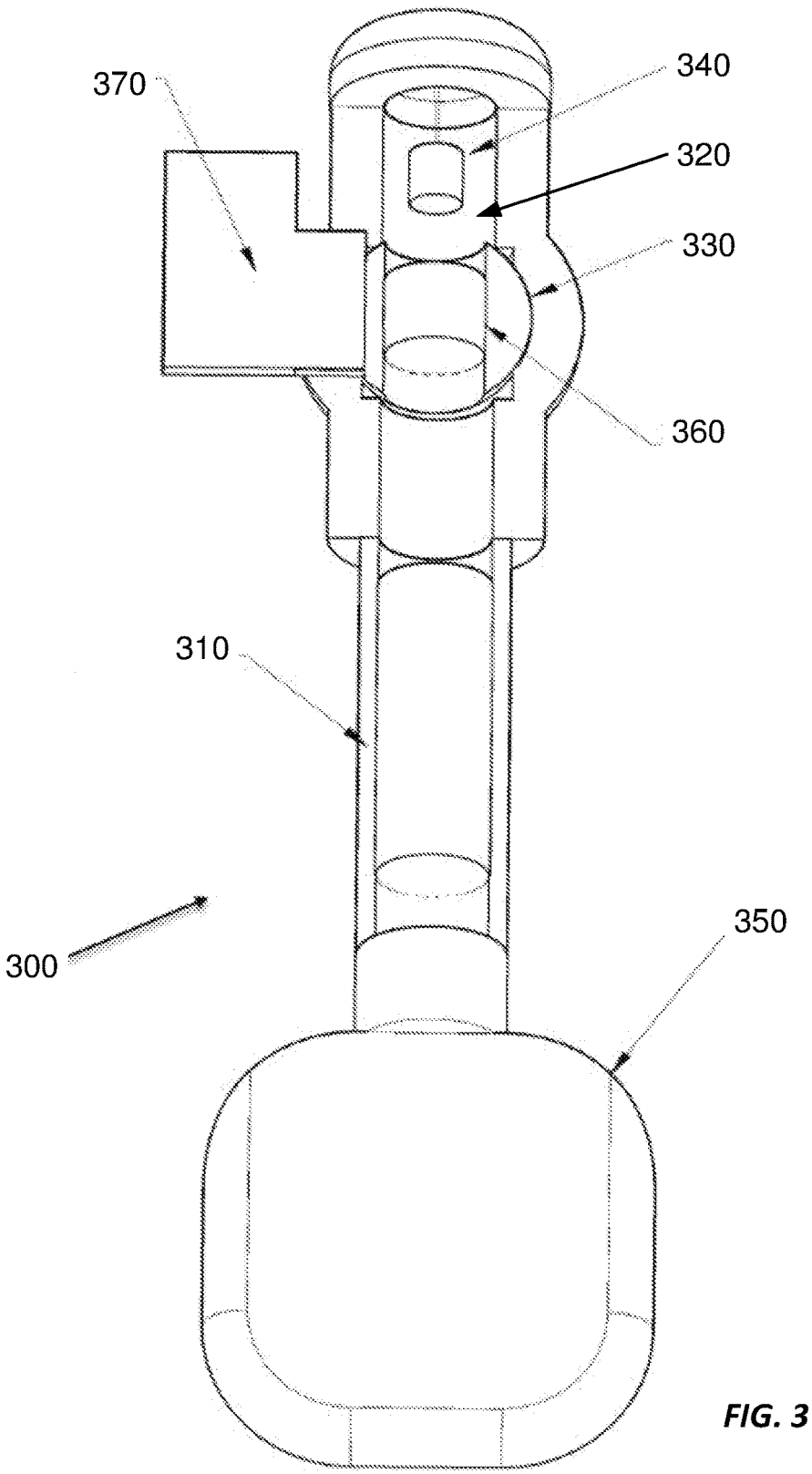
FIG. 3 is a schematic view yet another embodiment of an Explosive Device Simulator.

FIG. 3 is a schematic view of yet another embodiment of an Explosive Device Simulator. Explosive Device Simulator 300 includes a first chemical component container 310 including a first chemical component (such as hydrogen peroxide, $H_2O_2$). In some embodiments, hydrogen peroxide (i.e. the first chemical component) may be additionally mixed with water ($H_2O$).

Explosive Device Simulator 300 also includes a valve 330 that may be articulated by a valve handle 370. The valve 330 separates the first chemical component container 310 from a second chemical component container 320. The second chemical component container 320 contains a second chemical component (such as calcium carbide, $CaC_2$).

Also within the second chemical component container 320 is a detonator (such as a squib) 340. The detonator 340 may be detonated to cause an explosion. But notably, the detonator 340 would not cause an explosion even if detonated in the presence of the first or second chemical component individually. In some embodiments, detonator 340 may be connected directly to a power source via a detonator control component, such as a wire. In other embodiments, detonator 340 may include an integral power source (such as a battery). Additionally, detonator 340 may be connected to, for example, a wireless receiver, pressure plate, or other detonation control mechanism.

In the embodiment depicted in FIG. 3, the valve 330 separates the detonator from the mixing chamber 350 so that, for example, after the chemical components have been mixed in mixing chamber 350, the Explosive Device Simulator 300 may still be rendered mostly safe by closing off the detonator 340 from the mixing chamber 350 via the valve 330. In such a scenario, Explosive Device Simulator 300 would be "mostly safe" because the small amount of explosive mixture left in chemical component container 320 would not cause a substantial explosion.

Explosive Device Simulator 300 includes an expandable mixing chamber 350, such as a bladder or a balloon. An expandable (i.e. flexible) mixing chamber allows the Explosive Device Simulator to occupy less space when not "armed" and therefore can be stored and transported more efficiently. For example, in some embodiments the expandable mixing chamber may be folded so as to occupy less space.

Additionally, where other parts of the Explosive Device Simulator 300 are robust materials (e.g. hard plastics, PVC, metals, composites, and others), a flexible mixing chamber, such as mixing chamber 350, may be a user-replaceable part such that the rest of the Explosive Device Simulator may be reused between explosions. This is because the force of the explosion will tend to be channeled out the weakest portion of the Explosive Device Simulator, assuming that it is not so powerful as to fragment the entire simulator. In this way, Explosive Device Simulators may be more cost effective than other explosion training aids that require complete replacement after each use.

To activate or arm Explosive Device Simulator 300, valve 330 is opened by rotating valve handle 370. Opening valve 330 removes the barrier between the first chemical component (here, calcium carbide, $CaC_2$) and the second chemical component (here, hydrogen peroxide, $H_2O_2$) As described above, the first chemical component ($H_2O_2$) and the second chemical component ($CaC_2$) then react to form an explosive mixture (acetylene gas ($C_2H_2$) and oxygen ($O_2$)). The explosive mixture expands and fills the flexible mixing chamber (e.g. a balloon or expandable bladder) 350. At this point, Explosive Device Simulator 300 is ready for detonation.

Detonating the Explosive Device Simulator 300 involves activating the detonator 340 (here, a squib or electric match). As with other embodiments, the resulting explosion produces a loud "bang" and a flash, but with minimal overpressure, which minimizes the risk of injuries to personnel and damage to equipment.

Figure 4:
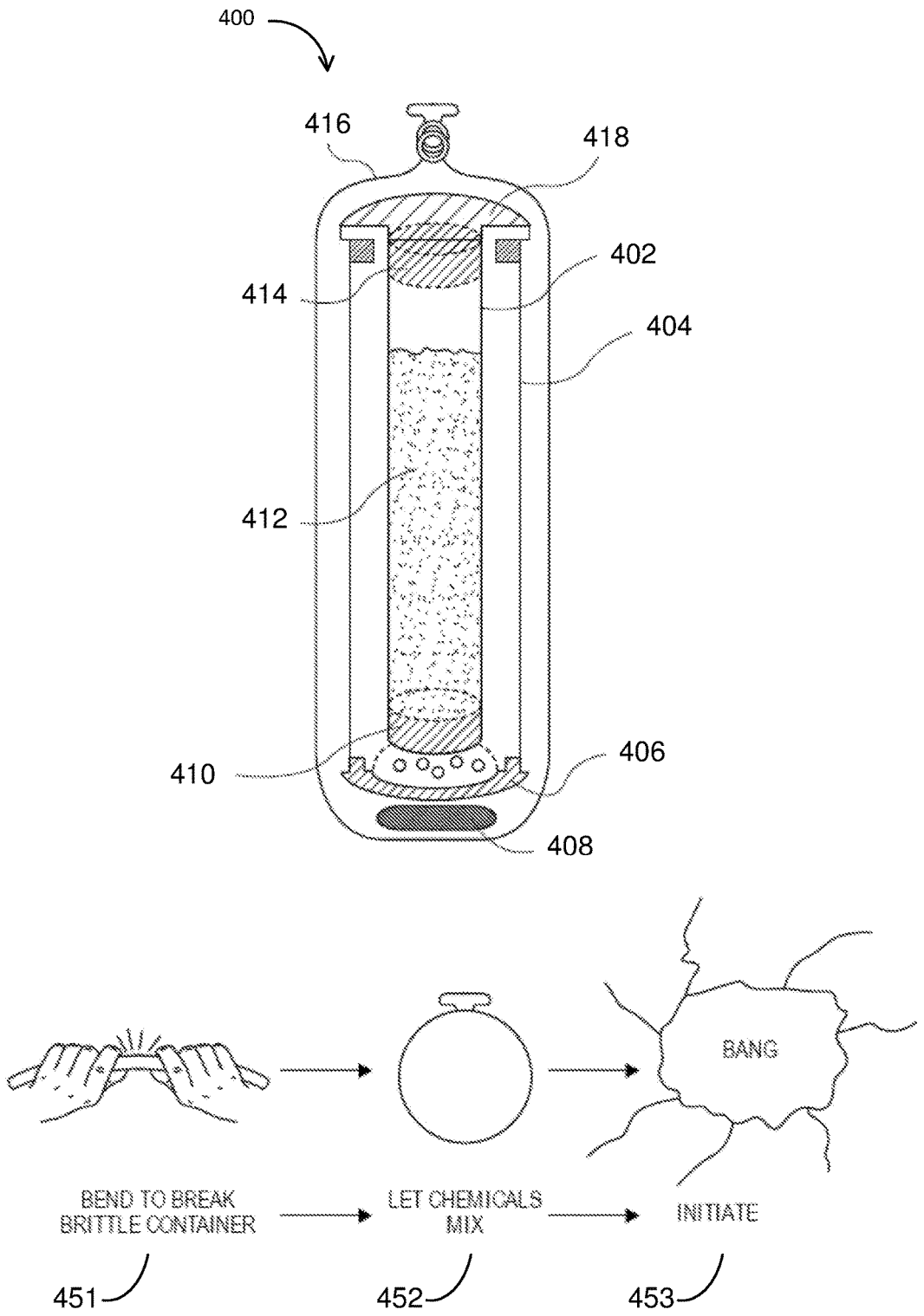
FIG. 4 is a schematic view yet another embodiment of an Explosive Device Simulator.

FIG. 4 is a schematic view of yet another embodiment of an Explosive Device Simulator. Explosive Device Simulator 400 includes a first chemical component container 402. In this embodiment, first chemical component container 402 is a rigid and brittle sealed container comprising a first chemical component 412. In this embodiment, the first chemical component is hydrogen peroxide ($H_2O_2$), though in other embodiments it may be a different substance. The first chemical component container 402 is sealed at both ends by container seals 410 and 414. Container seals 410 and 414 can be used to seal first chemical component container 402 after it has been filled with a chemical component, such as hydrogen peroxide ($H_2O_2$) in this embodiment.

First chemical component container 402 is brittle so that it can be broken or fractured readily. One fractured, the chemical component 412 stored within is able to flow out of the container 402 and make its way to the mixing chamber 416.

First chemical component container 402 is within a flexible container 404. Flexible container 404 has a seal 418 at one end and a perforated seal 406 at the other end. The perforated seal 406 allows for fluid to flow from the flexible container 404 after the brittle first component container 402 is broken. In this embodiment, flexible container 404 as meant to restrict any broken pieces of first component container 402 after it is broken, as described in more detail below. By restricting pieces of first component container 402, flexible container protects the non-rigid mixing chamber 416 as well as prevents broken pieces of the first chemical component container 402 from becoming dangerous shrapnel during an explosion. Note, other embodiments may not include a flexible container such as flexible container 404.

Explosive Device Simulator 400 also includes a mixing chamber 416. In this embodiment, mixing chamber 416 is an expandable balloon or bladder made of a stretchable material such as rubber. In this embodiment, mixing chamber 416 includes a second chemical component 408. In this embodiment, second chemical component 408 is a solid calcium carbide ($CaC_2$). In other embodiments, the second chemical component may be other substances. Additionally, mixing chamber 416 includes a catalyst chemical component (not shown), such as a yeast-based enzyme, manganese dioxide ($MnO_2$), or iron chloride ($FeCl_3$), and other as are known in the art. The catalyst chemical component causes the reaction between the first chemical component (hydrogen peroxide, $H_2O_2$) and the second chemical component (calcium carbide, $CaC_2$) to react more fully and efficiently so that the resulting explosive mixture is formed faster and more completely.

Explosive Device Simulator 400 may be used in a method shown in steps 451-453. In a first step 451, pressure may be applied to the Explosive Device Simulator 400 (e.g. by bending) so that the brittle first component container 402 breaks. When the brittle first component container 402 breaks, the first chemical component (liquid hydrogen peroxide, $H_2O_2$) flows into the flexible container 404 and then out of the perforated seal 406. Once out of the perforated seal 406, the first chemical component comes into contact with the second chemical component (calcium carbide, $CaC_2$) and the catalyst and starts to react to form an explosive mixture. In this embodiment, the explosive mixture includes acetylene gas. As the explosive mixture is formed, the expandable mixing chamber 416 fills as show in step 452. Finally, in step 453 the Explosive Device Simulator 400 is detonated using one of methods described above. Notably, the he expandable mixing chamber 416 of Explosive Device Simulator 400 allows an explosion to occur without completely destroying all of the internal components, such as flexible container 404, seals 406, 410, 414 and 418, etc. As such, those components may be re-used in a rebuilt Explosive Device Simulator 400.

The embodiments described above are exemplary. Aspects of each embodiment may be combined or excluded to form other embodiments of an Explosive Device Simulator.

Embodiments of Explosive Device Simulators, such as those described above, may be used in many different settings and scenarios. For example, the Explosive Device Simulators may be used for conducting counter-IED training for EOD and like personnel. In such a scenario, an Explosive Device Simulator may be concealed and armed as if it were a real IED. In this way, the Explosive Device Simulator may provide a very realistic, but relatively safe, training aid. Other training settings and scenarios include anti-terrorism training, convoy reaction drills, IED render safe exercises, basic training and noise exposure, ambush drills, and mass casualty drills.

Embodiments of Explosive Device Simulators may also be used in the entertainment industry. For example, when rehearsing for a particular scene, a simulated IED can be used in place of a real explosion. In this way, the Explosive Device Simulator provides audio and visual signals to the actors and/or stunt persons without the cost and danger of producing a larger real pyrotechnic effect. Thus, the individuals involved with a particular special effect (live or recorded) can rehearse safely and with minimal cost, and save actual pyrotechnic explosions for live or filming performances.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

What is claimed is:

1. An explosive device simulator, comprising:
- a first chemical component container containing a first chemical component;
- a second chemical component container containing a second chemical component;
- a first mixing control mechanism; and
- a detonator.

2. The explosive device simulator of claim 1, wherein the first chemical component and the second chemical component form an explosive mixture when mixed.

3. The explosive device simulator of claim 2, wherein the first mixing control mechanism is a seal between the first chemical component container and the second chemical component container.

4. The explosive device simulator of claim 3, further comprising: a mixing chamber formed when the seal between the first chemical component container and the second chemical component container is breached.

5. The explosive device simulator of claim 4, further comprising a second mixing control mechanism.

6. The explosive device simulator of claim 5, wherein the second mixing control mechanism is a container configured to degrade in the presence of the first chemical component in order to delay the initiation of a reaction between the first chemical component and the second chemical component.

7. The explosive device simulator of claim 6, further comprising a catalyst configured to catalyze the chemical reaction between the first chemical component and the second chemical component.

8. The explosive device simulator of claim 7, wherein the catalyst comprises manganese dioxide.

9. The explosive device simulator of claim 3, wherein the first chemical component is hydrogen peroxide ($H_2O_2$).

10. The explosive device simulator of claim 9, wherein the second chemical component is calcium carbide ($CaC_2$).

11. An explosive device simulator, comprising:
- a first chemical component container containing a first chemical component;
- a mixing chamber;
- a second chemical component container within the mixing chamber and containing a second chemical component;
- a mixing control mechanism; and
- a detonator.

12. The explosive device simulator of claim 11, wherein the first chemical component and the second chemical component form an explosive mixture when mixed.

13. The explosive device simulator of claim 12, wherein the mixing control mechanism is a seal between the first chemical component container and the mixing chamber.

14. The explosive device simulator of claim 13, wherein the second chemical component container is configured to degrade in the presence of the first chemical component in order to delay the initiation of a reaction between the first chemical component and the second chemical component.

15. The explosive device simulator of claim 14, further comprising a catalyst configured to catalyze the chemical reaction between the first chemical component and the second chemical component.

16. The explosive device simulator of claim 15, wherein the catalyst comprises manganese dioxide.

17. The explosive device simulator of claim 13, wherein the first chemical component is hydrogen peroxide ($H_2O_2$).

18. The explosive device simulator of claim 17, wherein the second chemical component is calcium carbide ($CaC_2$).

19. An explosive device simulator, comprising:
- a bladder, comprising:
  - a first chemical component container containing hydrogen peroxide ($H_2O_2$);
  - a second chemical component container containing calcium carbide ($CaC_2$); and
  - a barrier separating the first chemical component container from the second chemical component container;
- a mixing chamber formed when the barrier between the first chemical component container and the second chemical component container is breached;
- a mixing control mechanism; and
- a detonator.

20. The explosive device simulator of claim 19, wherein the mixing control mechanism is a container configured to degrade in the presence of the first chemical component in order to delay the initiation of a reaction between the first chemical component and the second chemical component.

* * * * *